US007822359B2

(12) United States Patent
Kawahara et al.

(10) Patent No.: US 7,822,359 B2
(45) Date of Patent: Oct. 26, 2010

(54) IMAGE FORMING APPARATUS HAVING A CONTROL DEVICE WHICH IS ROTATABLY LINKED

(75) Inventors: Koji Kawahara, Tokyo (JP); Junji Shirakawa, Tokyo (JP); Mamoru Takayama, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 587 days.

(21) Appl. No.: 11/848,814

(22) Filed: Aug. 31, 2007

(65) Prior Publication Data

US 2008/0056761 A1 Mar. 6, 2008

(30) Foreign Application Priority Data

Sep. 6, 2006 (JP) ..... 2006-241075
Aug. 1, 2007 (JP) ..... 2007-200666

(51) Int. Cl.
*G03G 15/00* (2006.01)

(52) U.S. Cl. ..... 399/107; 399/88; 399/92; 399/110

(58) Field of Classification Search ..... 399/92, 399/98, 88, 107, 110
See application file for complete search history.

(56) References Cited

U.S. PATENT DOCUMENTS 6,308,026 B1 * 10/2001 Kouchi ..... 399/110

FOREIGN PATENT DOCUMENTS

| | | |
|---|---|---|
| JP | 57-93180 | 6/1982 |
| JP | 4-19175 | 1/1992 |
| JP | 5-336623 | 12/1993 |
| JP | 6-196871 | 7/1994 |
| JP | 10-22655 | 1/1998 |
| JP | 2000-227748 | 8/2000 |
| JP | 2001-28485 | 1/2001 |

* cited by examiner

*Primary Examiner*—David P Porta
*Assistant Examiner*—Milton Gonzalez
(74) *Attorney, Agent, or Firm*—Oblon, Spivak, McClelland, Maier & Neustadt, L.L.P.

(57) ABSTRACT

An image forming apparatus that can improve the workability during maintenance, and the compactness and neatness of the signal line and the power source line, and moreover can lower the cost by eliminating the fall preventing member. The image forming apparatus has: an engine main body which has an image forming device, a transfer device, a fixer, and a transporter. There is a rear surface unit which has housed items such as a power source device, a control device, and an exhaust device, and which is configured to be detachable from the engine main body. One end of the control device is rotatably linked to the engine main body while the other end thereof is rotatably linked to the unit main body.

12 Claims, 5 Drawing Sheets

IMAGE FORMING APPARATUS HAVING A CONTROL DEVICE WHICH IS ROTATABLY LINKED

BACKGROUND OF THE INVENTION

1. Field of the Invention

The present inventions relates to an image forming apparatus such as an electrophotographic copying apparatus, a laser printer, or a complex machine thereof, and particularly relates to an image forming apparatus having a rear surface unit that is detachable from an engine main body.

2. Description of the Related Art

Conventional, in comparably large scale image forming apparatuses with the width thereof exceeding one meter, in order to simplify the repair of the engine main body, the structures of the power source, control portion, exhaust system and the like positioned on the back surface of an apparatus main body have normally been combined together in a separate unit (referred to below as the rear surface unit), and when performing repair the rear surface unit can be easily detached from the engine main body. With this structure, the efficiency of maintenance and checking operations is increased and, due to suppressing the width of each unit to 800 mm or less when the image forming apparatus is disassembled in order to meet the minimum opening width standards for an elevator, the transport of the apparatus has been improved.

In this type of image forming apparatus, normally the rear surface unit connected to the engine main body is formed having a smaller installation area and a substantially equal height compared to that of the engine main body. Thus the installation area of the rear surface unit is small compared with the height from the contact surface of the unit center of gravity and thus the rear surface unit has a structure that easily falls over when detached. For this reason, it is necessary to install a fall preventing member to prevent the rear surface unit from falling over.

An example of such a fall preventing member is disclosed in for example Japanese Unexamined Utility Model Application No. S57-93180 and Japanese Unexamined Utility Model Application No. H6-196871. However, both of the above have problems that need to be solved and that will be discussed below with reference to the diagrams.

Technologies relating to the present invention are also disclosed in, for example, Japanese Unexamined Patent Application No. H5-336623 and Japanese Unexamined Patent Application No. H4-019175.

SUMMARY OF THE INVENTION

It is an object of the present invention to provide an image forming apparatus that solves the above mentioned problems that can improve the workability during maintenance, that can improve the compactness and neatness of the signal line and the power source line, and that can lower the cost by eliminating the fall preventing member.

In an aspect of the present invention, an image forming apparatus comprises an engine main body which has an image forming device, a transfer device, a fixing device and a transport device, and which performs an image forming operation, a transfer operation and a fixing operation; and a rear surface unit which has housed items such as a power source device, a control device, and an exhaust device, and which is configured to be detachable from the engine main body. The rear surface unit has a unit main body for housing the housed items, the unit main body is detachable from the engine main body, the control device housed in the rear surface unit has a box shape, and one end of the control device is rotatably linked to the engine main body while the other end thereof is rotatably linked to the unit main body.

BRIEF DESCRIPTION OF THE DRAWINGS

The above and other objects, features and advantages of the present invention will become more apparent from the following detailed description taken from the accompanying drawings in which.

DESCRIPTION OF THE PREFERRED EMBODIMENTS

Before giving an explanation of the present invention an explanation will be given of the prior art and the problems thereof.

Figure 1A:
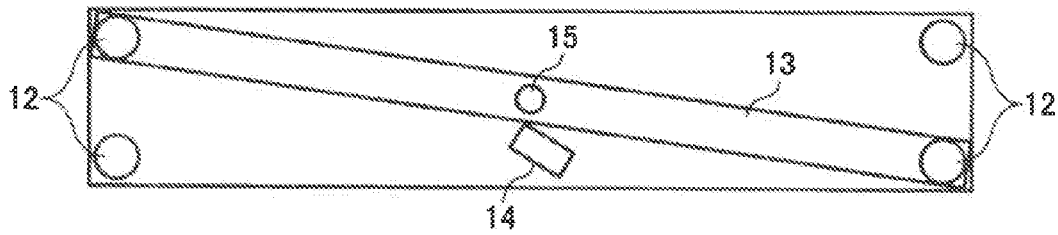
FIG. 1A PRIOR ART
FIGS. 1A, 1B, 2A and 2B are bottom views showing an outline of the structure of each example of a fall preventing member found in the prior art.
Figure 1B:
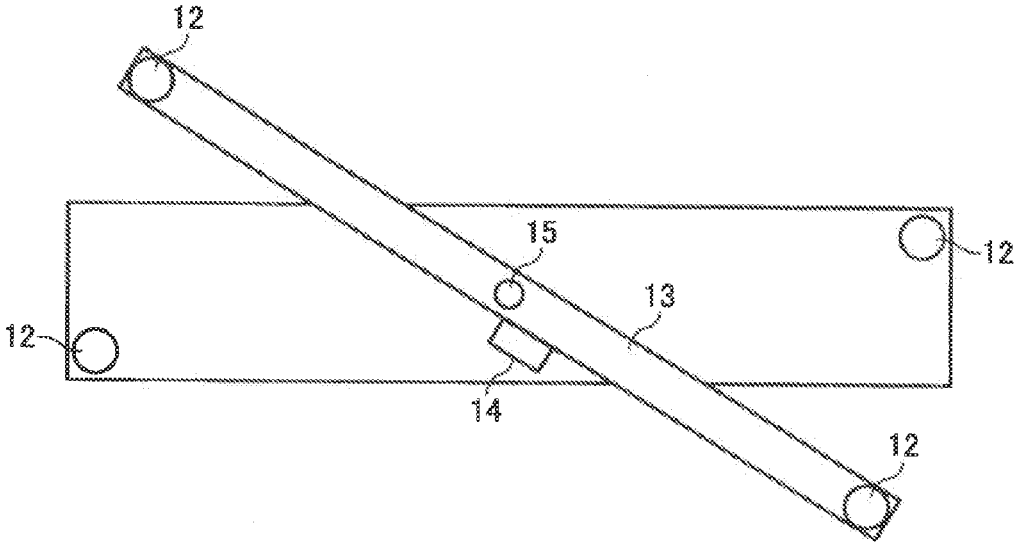
FIG. 1B PRIOR ART

FIGS. 1A and 1B show the structure of the bottom surface of a fall preventing member disclosed in the previously mentioned Japanese Unexamined Utility Model Application No. S57-93180. As shown in the drawing, in this prior art, an arm 13, having a leveler 12 on both ends of each of a pair of rectangular wires, is disposed, the arm 13 is attached rotatably to the rear surface unit using a bolt 15, and the rear surface unit is prevented from falling over due to the rotation being limited to the position in which the arm 13 and a stopper 14 abut.

Figure 2A:
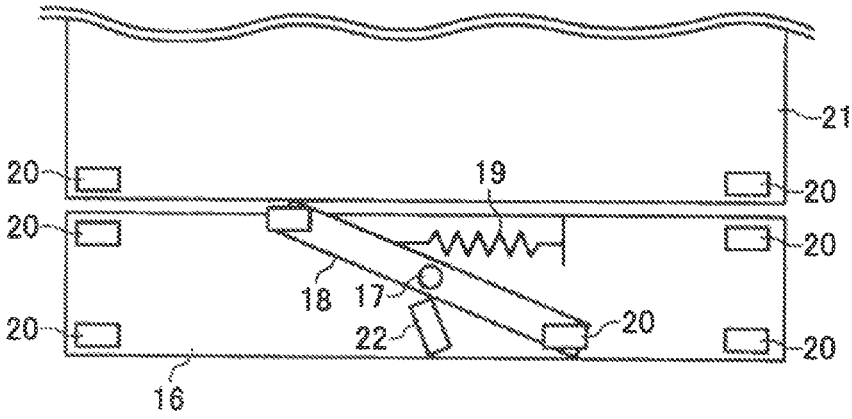
FIG. 2A PRIOR ART
Figure 2B:
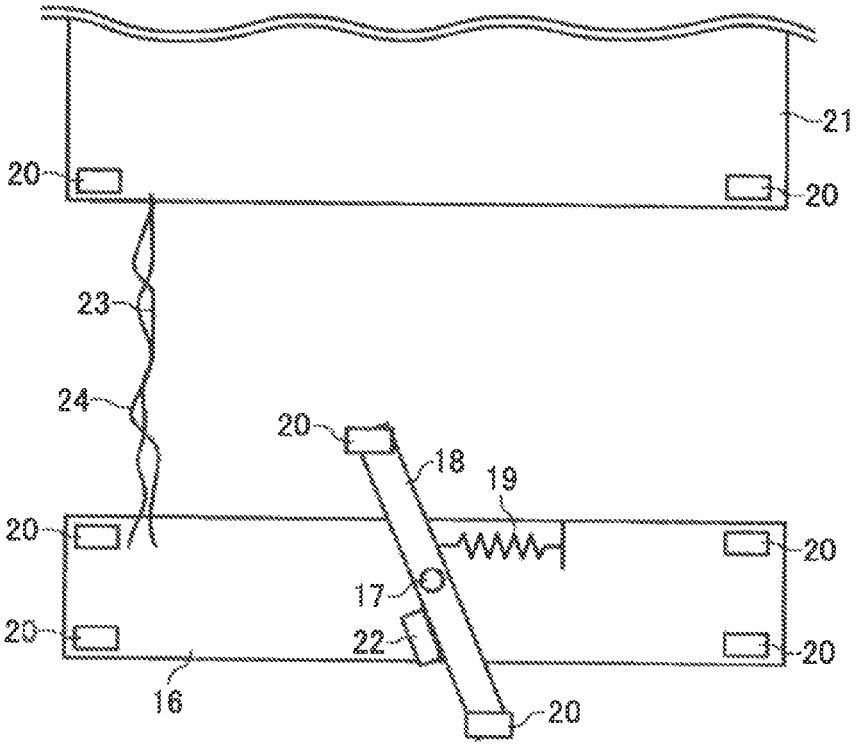
FIG. 2B PRIOR ART

FIGS. 2A and 2B show the structure of the bottom surface of a fall preventing member disclosed in the previously mentioned Japanese Unexamined Utility Model Application No. H6-196871. As shown in the drawing, in this prior art, an arm 18, which is supported rotatably by a bolt 17 while being biased to protrude out from the bottom surface of a rear surface unit 16 due to a spring 19, and which has casters 20 on both ends thereof, is provided on the center portion of the bottom surface of the rear surface unit 16, and when an engine main body 21 and the rear surface unit 16 are linked to each other, as shown in FIG. 2A, one end of the arm 18 abuts the engine main body 21 to cause the arm 18 to be accommodated in the bottom surface of the rear surface unit 16, and when the rear surface unit 16 is detached from the engine main body 21, as shown in FIG. 2B, the rear surface unit 16 is prevented from falling over because the spring 19 causes the arm 18 to rotate until the arm 18 abuts a stopper 22.

However, in the technology disclosed in the previously mentioned Japanese Unexamined Utility Model Application No. S57-93180, it is necessary to pull out by hand the arm 13 in which legs comprising both ends of the leveler 12 are attached, thus there is a difficulty in the operation and a danger that someone's leg or the like will get caught in the arm 13 when the arm 13 is left in a pulled out state.

In the technology disclosed in the previously mentioned Japanese Unexamined Utility Model Application No. H6-196871, when the rear surface unit 16 is detached from the engine main body 21, as shown in FIG. 2B, a signal line 23 and a power source line 24, which both are connected from the rear surface unit 16 and the engine main body 21, have to be made longer to the extent of the distance that the rear surface unit 16 moves, and thus a problem is created in which each line 23 and 24 is dragged across the installation surface so that someone can step on or get their leg caught in the lines 23 and 24. Also, when the rear surface unit 16 is linked to the engine main body 21, a problem is created in which the lines 23 and 24 are pinched or in which a difficulty is caused in that the lines 23 and 24 must be rolled up.

Furthermore, a problem is created in both of these disclosed technologies in that costs rise due to attaching a fall preventing member.

Below a detailed explanation will be given of the present invention, which solves the above problems in the prior art, with reference to the drawings.

Figure 3A:
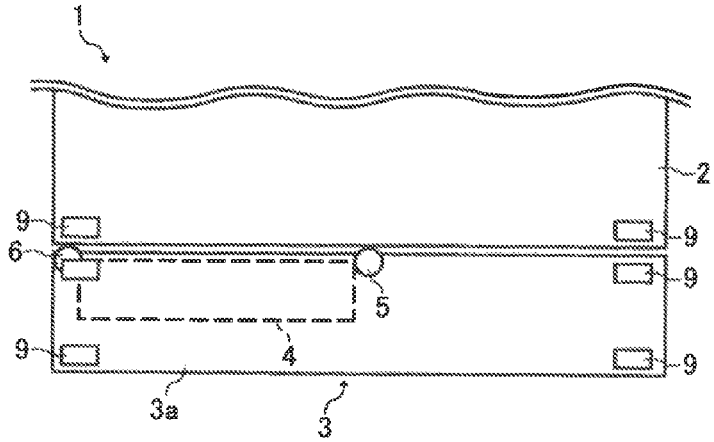
FIG. 3A is a partial outline of a plan view at the time in which the engine main body and the rear surface unit of the image forming apparatus, used in a first embodiment of the present invention, are connected.
Figure 3B:
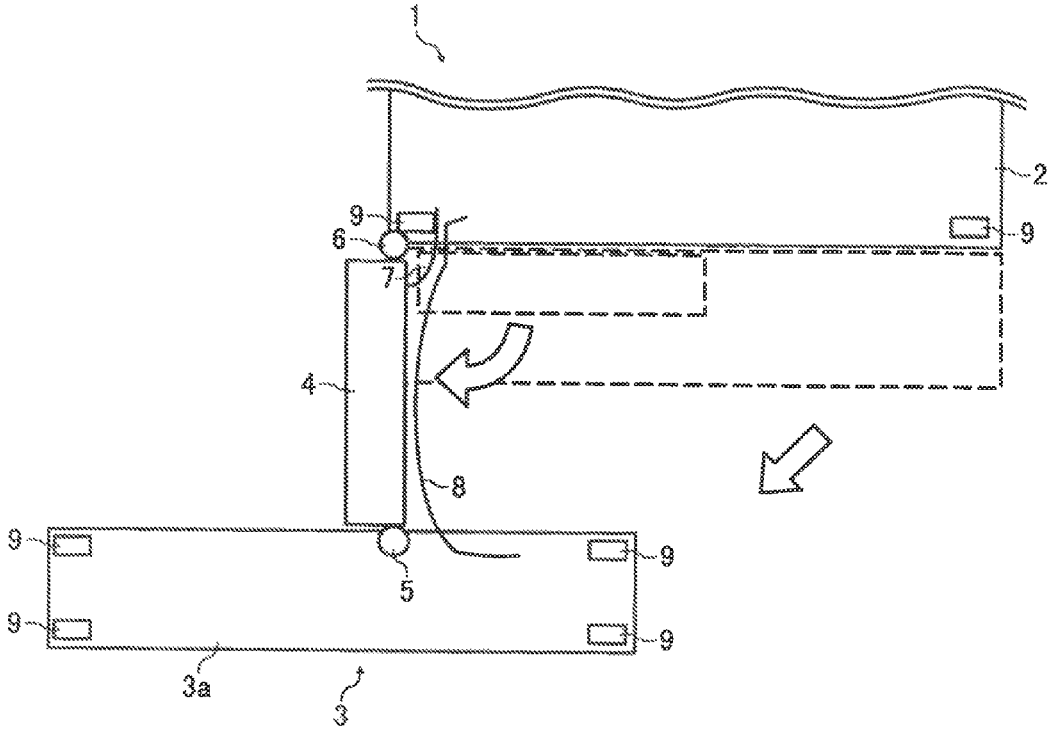
FIG. 3B is a partial outline of a plan view at the time in which the engine main body and the rear surface unit are detached from each other.

FIGS. 3A and 3B show the structure of an image forming apparatus according to a first embodiment of the present invention. In these drawings an image forming apparatus 1, which is a color laser printer, has an engine main body 2 for performing image formation, and a rear surface unit 3, which houses a power source device 10 (refer to FIG. 5), a control device 4, an exhaust device 11 (refer to FIG. 5) and the like, and which is detachable from the engine main body 2. The image forming apparatus 1 is configured to perform image forming processing on image information received from an outer portion on the basis of image signals and to perform image formation, not just on standard paper used in general copying, but also on OHP sheets used as a sheet-like recording medium, on thick paper such as cards or postcards, on envelopes, and the like.

Figure 4:
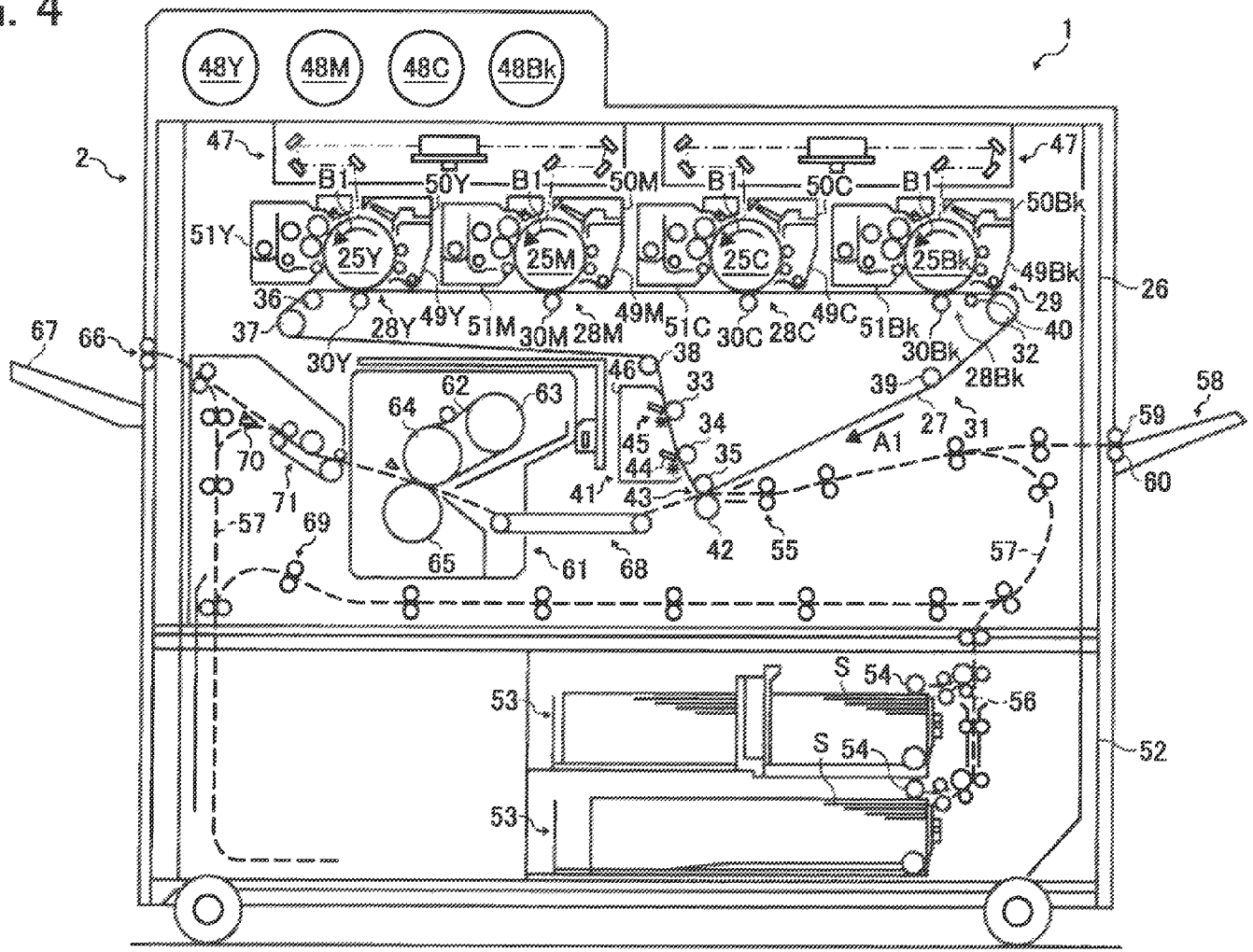
FIG. 4 is a front view showing an outline of the structure of the engine main body used in the first embodiment.

As is shown in FIG. 4, the engine main body 2 has a tandem structure in which photosensitive body drums 25Y, 25M, 25C and 25Bk are disposed in parallel, the photosensitive drums being latent image support bodies which can perform image formation for each of yellow, magenta, cyan and black. Each photosensitive body drum 25Y, 25M, 25C and 25Bk are supported rotatably by a frame, which is provided on an apparatus main body 26 of the engine main body 2 and which is not shown in the drawings, and are disposed in the order as written on the upstream side of a direction shown by an arrow A1, which is the movement direction of a transfer belt 27 and which is the clockwise direction in FIG. 4. The Y, M, C and Bk added to the number of each notation signify a member for yellow, magenta, cyan and black, respectively. Each photosensitive body drum 25Y, 25M, 25C and 25Bk is provided in a respective image forming unit 28Y, 28M, 28C and 28Bk, which are for forming a yellow, magenta, cyan and black image, respectively, and each photosensitive body drum 25Y, 25M, 25C and 25Bk is disposed on an image making surface side which is the outer periphery surface side of the transfer belt 27.

Each image forming unit 28Y, 28M, 28C and 28Bk is configured in the same manner, and each has, on the periphery of each photosensitive body drum 25Y, 25M, 25C and 25Bk, a primary transfer roller 30Y, 30M, 30C and 30Bk, a cleaning device 49Y, 49M, 49C and 49Bk, a charging device 50Y, 50M, 50C and 50Bk and a developing device 51Y, 51M, 51C and 51Bk arranged along the rotation direction B1 of each photosensitive body drum 25Y, 25M, 25C and 25Bk, which is the counterclockwise direction in FIG. 4.

A transfer belt unit 31, having the transfer belt 27 which is the intermediate transfer body, is disposed in the substantial center of the inner portion of the apparatus main body 26. The transfer belt unit 31 has the transfer belt 27, the primary transfer rollers 30Y, 30M, 30C and 30Bk, a drive roller 32, cleaning opposed rollers 33 and 34, support rollers 35, 36, 37, 38, 39 and 40, a belt cleaning device 41, drive means, not shown in the drawings, for rotationally driving the drive roller 32, and power source and bias control means, not shown in the drawings, for applying a primary transfer bias to the primary transfer rollers 30Y, 30M, 30C and 30Bk.

The cleaning opposed rollers 33 and 34 and the support rollers 35, 36, 37, 38, 39 and 40 rotate in correspondence to the movement of the running transfer belt 27 due to the rotation of the drive roller 32. The primary transfer rollers 30Y, 30M, 30C and 30Bk press the transfer belt 27 from the back side thereof to each photosensitive body drum 25Y, 25M, 25C and 25Bk, respectively, so that each primary transfer nip is formed. These primary transfer nips are formed in a portion supported between the support rollers 36 and 40 of the transfer belt 27, and the support rollers 36 and 40 have a function of stabilizing the primary transfer nips. In each primary transfer nip, a primary transfer electric field is formed between each photosensitive body drum 25Y, 25M, 25C and 25Bk due to the effect of the primary transfer bias. The toner image for each color formed on each photosensitive body drum 25Y, 25M, 25C and 25Bk is primarily transferred to the transfer belt 27 due to the influence of the primary transfer electric field, the nip pressure and the like. The support rollers 36 and 37 are configured so that, at the time of the black image formation, they move downward along with the primary transfer rollers 30Y, 30M and 30C and 30Bk, and thus separate the transfer belt 27 from each photosensitive body drum 25Y, 25M, 25C and 25Bk.

The belt cleaning device 41 is disposed opposing the transfer belt 27 to the left and the right of the cleaning opposed rollers 33 and 34 in FIG. 4, on the downstream side of the support roller 35 in the direction shown by arrow A1. The belt cleaning device 41 has a cleaning blade 44 for cleaning the transfer belt 27 and is disposed at a position that opposes the cleaning opposed roller 34 via the transfer belt 27, has a lubricant coating device 45 disposed at a position that opposes the cleaning opposed roller 33 via the transfer belt 27, and has a case 46 which houses the cleaning blade 44 and the lubricant coating device 45. The belt cleaning device 41 cleans the transfer belt 27 by removing foreign objects such as residual toner from the transfer belt 27 using the cleaning blade 44.

The transfer belt 27 is provided movably in the direction of arrow A1 while still facing each photosensitive body drum 25Y, 25M, 25C and 25Bk. The toner images formed in each photosensitive body drum 25Y, 25M, 25C and 25Bk are configured to be respectively transferred superimposed on the moving transfer belt 27, and afterwards collectively transferred to a transfer sheet S which is the recording medium. The portion on the upper side of the transfer belt 27 opposes each photosensitive body drum 25Y, 25M, 25C and 25Bk, and this opposing portion structures a primary transfer portion 29 for transferring the toner images of each photosensitive body drum 25Y, 25M, 25C and 25Bk to the transfer belt 27. The superimposed transfer on the transfer belt 27 is performed from the upstream side of the A1 direction to the downstream side with a spaced timing through the application of a voltage, via the transfer belt 27, from each primary transfer roller 30Y, 30M, 30C and 30Bk, which are respectively disposed opposing each photosensitive body drum 25Y, 25M, 25C and 25Bk, so that during the process in which the transfer belt 27 moves in the direction of arrow A1, the toner images respectively formed on each photosensitive body drum 25Y, 25M, 25C and 25Bk are transferred superimposed on the same position on the transfer belt 27.

The transfer belt 27 is structured from a multilayer construction having a base layer formed from a material that does not stretch much and a coating layer structured by coating the surface of the base layer with a material having a good lubricity. A fluoride resin, a PVD sheet, a polyimide resin or the like can be used as the material for the base layer, and a fluoride resin or the like can be used as the material for the coating layer. The transfer belt 27 has a guide member on each edge thereof, in which the guide member, not shown in the drawings, is a slippage preventing member, and the guide members are disposed so as to prevent deviation of the sheet surface in a perpendicular direction in FIG. 4 when the transfer belt 27 rotates in the direction of arrow A1. Various types of rubber such as urethane rubber or silicon rubber can be used as the material for the guide member.

A secondary transfer roller 42 is disposed at a position opposing the support roller 35 via the transfer belt 27. The secondary transfer roller 42 has a pressure contact with the support roller 35 via the transfer belt 27, and a secondary transfer portion 43 is formed at this pressure contact portion. The support roller 37 provides a prescribed tension on the transfer belt 27, and thus functions as a tension roller. A secondary transfer electric field is formed in the secondary transfer portion 43 through the effect of the secondary transfer bias. The toner images formed on the transfer belt 27 are secondarily transferred on the transfer sheet S through the influence of the secondary transfer electric field, the nip pressure, and the like. The support roller 35 also acts as a secondary transfer opposed roller.

Light scanning devices 47, which act as a write unit for light forming a static electric latent image on each photosensitive body drum 25Y, 25M, 25C and 25Bk, are disposed on each image forming unit 28Y, 28M, 28C and 28Bk, and toner bottles 48Y, 48M, 48C and 48Bk, which are filled respectively with each color, yellow, magenta, cyan and black, are disposed above one of the light scanning devices 47. Each color of toner filled in each toner bottle 48Y, 48M, 48C and 48Bk is supplied to each developing device 51Y, 51M, 51C and 51Bk in only a prescribed quantity via a transfer path not shown in the drawings.

A sheet feed table 52, on which the apparatus main body 26 is placed, is disposed beneath the apparatus main body 26, and a plurality of sheet feed devices 53, which store the transfer sheet S to be fed towards the secondary transfer portion 43, are disposed in the inner portion of the sheet feed table 52. The sheet feed devices 53 house a plurality of the stacked transfer sheets S in a bundled state, and in the present embodiment are disposed in the sheet feed table 52 in two levels, top and bottom. The sheet feed devices 53 each have a feed roller 54, which has a pressure contact with the top surface of the uppermost transfer sheet S, and the uppermost transfer sheet S is fed towards the apparatus main body 26 due to the rotational drive of the feed rollers 54 in a counterclockwise direction in FIG. 4 at a prescribed timing.

A resist roller pair 55 is provided, on the right side of the secondary transfer portion 43, for feeding the transfer sheet S, fed from the sheet feed device 53, towards the secondary transfer portion 43 at a prescribed timing in synchronization with the formation of the toner images by each image forming unit 28Y, 28M, 28C and 28Bk, and a sensor, not shown in the drawings, is provided for detecting the arrival of the tip end of the transfer sheet S at the resist roller pair 55. The transfer sheet S fed from the sheet feed device 53 reaches the resist roller pair 55 via a sheet feed path 56 and is held pinched by the resist roller pair 55. In FIG. 4 a plurality of transport rollers, with no notation supplied, are shown inside the apparatus main body 26, and all of these transport rollers act to transport the transfer sheet S and form a sheet feed path 57, shown by a dashed line, inside the apparatus main body 26 and the sheet feed table 52.

A manual tray 58, for use when performing manual sheet feed, is disposed on the right side portion of the apparatus main body 26. A sheet feed roller 59 for feeding a placed transfer sheet S towards the resist roller pair 55, and a separation roller 60, disposed in opposition to the sheet feed roller 59, and for separating the transfer sheet S fed by the sheet feed roller 59 into individual sheets, are both disposed on the downstream side tip portion of the transfer sheet transport direction of the manual tray 58.

A fixing device 61, for fixing the toner image on the transfer sheet S to which a toner image has been transferred, is disposed on the left side of the secondary transfer portion 43. The fixing device 61 has a fixing belt 62 formed from an endless belt, a heating roller 63, on which the fixing belt 62 is wound and suspended, and which has an internal heat source, a fixing roller 64, on which the fixing belt 62 is wound and suspended, a pressure roller 65 for applying a pressure contact to the fixing roller 64, and the like. The fixing device 61 fixes a received toner image, using heat and pressure, on the surface of the transfer sheet S by holding the transfer sheet S, which received the toner image, pinched in a fixing portion, which is the pressure contact portion of the fixing belt 62 and the pressure roller 65, which are positioned on the fixing roller 64.

A sheet dispenser roller 66, for dispensing fixed transfer sheet S to the outer portion of the apparatus main body 26, and a sheet dispenser tray 67, for stacking transfer sheet S dispensed by the sheet dispenser roller 66, are disposed on the left side of the fixing device 61. A transport device 68, formed from a belt conveyor for transporting the transfer sheet S that has passed through the secondary transfer portion 43 to the fixing device 61, is disposed between the secondary transfer portion 43 and the fixing device 61. A fixed guide plate is used as the transport device 68.

A reverse rotation unit 69 for reversing the rotation of the fixed transfer sheet S which has passed through the fixing device 61, and feeding the fixed transfer sheet S once more towards the resist roller pair 55, a switching guide 70 for switching between guiding the fixed transfer sheet S which has passed through the fixing device 61 to the sheet dispenser roller 66 or to the reverse rotation unit 69, and a transport device 71 for transporting the fixed transfer sheet S which has passed through the fixing device 61 toward the switching guide 70 are disposed in between the fixing device 61 and the sheet dispenser roller 66. Furthermore, power source and bias control means, not shown in the drawings, for applying a secondary transfer bias to the secondary transfer roller 42, drive means, not shown in the drawings, for rotationally driving each photosensitive body drum 25Y, 25M, 25C and 25Bk, control means, not shown in the drawings, for controlling the overall operation of the image forming apparatus 1, and the like are provided in the inner portion of the apparatus main body 26.

In the engine main body 2 in the above structure, when a signal is input indicating the formation of a color image, the drive roller 32 is driven, the transfer belt 27, the cleaning opposed rollers 33 and 34, and the support rollers 35, 36, 37, 38, 39 and 40 rotate, and each photosensitive body drum 25Y, 25M, 25C and 25Bk is rotationally driven in the direction of arrow B1. Each of the photosensitive body drums 25Y, 25M, 25C and 25Bk have a uniform charge formed on the surfaces thereof, as they rotate, by the charging devices SOY, 50M, 50C and 50Bk, and form a static electric latent image for each color, yellow, magenta, cyan and black, through the exposure scanning of the light scanning devices 47. The formed static electric latent images are developed by the developing devices 51Y, 51M, 51C and 51Bk using each toner color, yellow, magenta, cyan and black, and each single color image structured respectively by the toner image for each color, yellow, magenta, cyan and black, is formed on the respective photosensitive body drum 25Y, 25M, 25C and 25Bk. The toner images, for each color, obtained through developing, are transferred to the same location on the transfer belt 27 in sequence by the primary transfer rollers 30Y, 30M, 30C and 30Bk, and a synthesized color image is formed on the transfer belt 27.

On the other hand, when a signal is input indicating the formation of a color image, one of the sheet feed devices 53 is selected, the feed roller 54 of the selected sheet feed device 53 rotates, and a transfer sheet S is separated from the stack and fed into the sheet feed path 56. The transfer sheet S fed into the sheet feed path 56 is further fed to the sheet feed path 57 and temporarily stops in a state abutted against the resist roller pair 55. When the transfer sheet S is placed on the manual tray 58, the sheet feed roller 59 rotates, the transfer sheet S is fed, the fed transfer sheet S is separated by the separation roller 60, fed to the sheet feed path 57, and temporarily stops in a state abutted against the resist roller pair 55.

The resist roller pair 55 rotates in synchronization with the timing in which the synthesized color image superimposed on the transfer belt 27 moves to the secondary transfer portion 43 in conjunction with the movement of the transfer belt 27, the synthesized color image adheres to the fed transfer sheet S in the secondary transfer portion 43, and the synthesized color image is secondarily transferred to the transfer sheet S due to the effect of the nip pressure and the bias. The transfer sheet S, to which the synthesized color image has been transferred, is fed to the fixing device 61 by the transport device 68, and the synthesized color image is fixed onto the transfer sheet S due to the effect of the heat and pressure when the transfer sheet S passes through the fixing portion in the fixing device 61.

The transfer sheet S, which has passed through the fixing device 61 and to which the synthesized color image has been fixed, passes through the transport device 71, and in accordance with the orientation of the switching guide 70, is stacked on the sheet dispenser tray 67 after passing through the sheet dispenser roller 66, or is supplied via the reverse rotation unit 69 to undergo image formation once more. Note that once the transfer sheet S passes through the reverse rotation unit 69 it has an image formed on both sides thereof, and is thus dispensed to and stacked on the sheet dispenser tray 67.

The residual toner remaining after the transfer process on each photosensitive body drum 25Y, 25M, 25C and 25Bk is removed by the cleaning devices 49Y, 49M, 49C and 49Bk, and the photosensitive body drums 25Y, 25M, 25C and 25Bk are prepared for the next image formation by being charged by the charging devices 50Y, 50M, 50C and 50Bk. The transfer belt 27, which has passed through the secondary transfer portion 43 ending the secondary transfer, has the surface thereof cleaned by the belt cleaning device 41, and is thus prepared for the text transfer.

Figure 5:
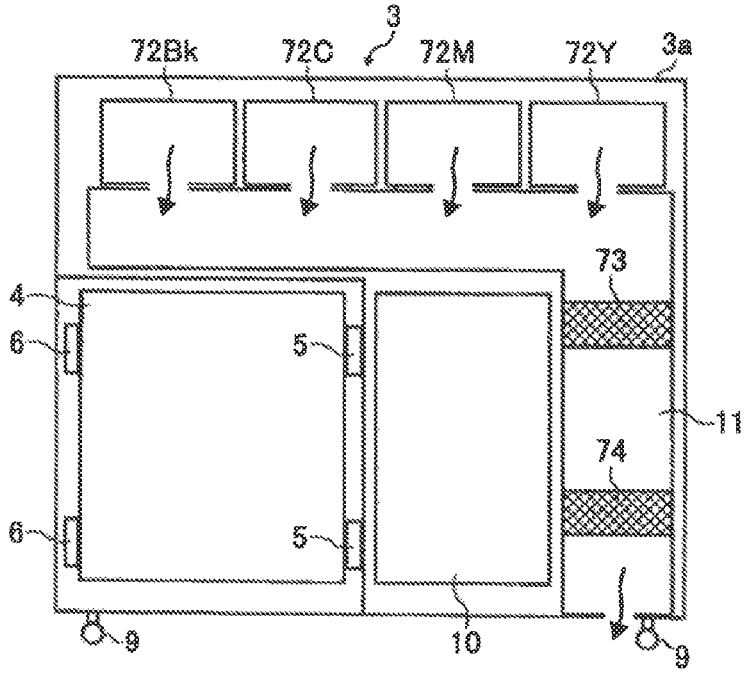
FIG. 5 is a rear view showing an outline of the structure of the image forming apparatus used in the first embodiment.

The rear surface unit 3 has a box-shaped unit main body 3*a*, and casters 9 are attached to the four corners of the bottom surface of the unit main body 3*a*. The control device 4 is disposed, as shown in FIG. 5, in the inner portion of the unit main body 3*a*. The box-shaped control device 4 is attached rotatably on one end thereof to the engine main body 2 by a hinge 6 and on the other end thereof to the unit main body 3*a* by a hinge 5. The signal line 7 and the power source line 8, acting as a harness to connect the engine main body 2 and the rear surface unit 3, are disposed along the control device 4 at a prescribed spacing from the control device 4, and the power source line 8 is connected to the power source device 10. The exhaust device 11 structures a ventilation exhaust path for the engine main body 2 when in a state in which the engine main body 2 and the rear surface unit 3 are linked.

Exhaust is generated including airborne toner and ozone from the image forming units 28Y, 28M, 28C and 28Bk of the engine main body 2 connected to the rear surface unit 3, however, it is preferable that this exhaust is processed by passing through a filter, and then discharged outside the apparatus. In the present embodiment a fan is provided on the rear surface of each image forming unit 28Y, 28M, 28C and 28Bk, and the exhaust from each image forming unit 28Y, 28M, 28C and 28Bk is discharged to the exhaust device 11 passing through ducts 72Y, 72M, 72C and 72Bk provided in the rear surface unit 3, and then the exhaust is collectively processed by a dust filter 73 and an ozone filter 74 provided in the exhaust device 11. It is also possible to provide a dust filter and an ozone filter in each duct 72Y, 72M, 72C and 72Bk. Air that is collectively processed by the dust filter 73 and the ozone filter 74 is collectively discharged beneath the exhaust device 11.

In the above structure, when the rear surface unit 3 is attached to the engine main body 2, as shown in FIG. 3A, the control device 4 is housed in the inner portion of the unit main body 3*a* of the rear surface unit 3, and when the rear surface unit 3 is detached from the engine main body 2, as shown in FIG. 3B, the unit main body 3*a* is detached from the engine main body 2 while the control device 4 maintains a connection between the engine main body 2 and the rear surface unit 3 via the hinges 5 and 6. In the state shown in FIG. 3B, one surface of the chassis of the control device 4 is exposed, thus maintenance can be performed in the inner portion of the control device 4.

With the above structure, a working space between the engine main body 2 and the rear surface unit 3 when performing maintenance can be secured without completely disassembling the engine main body 2 and the rear surface unit 3, thus the efficiency of performing maintenance is improved and the cost is lowered due to the fall preventing member being rendered unnecessary. Moreover, the compactness and neatness of the signal line 7 and the power source line 8, which connect the engine main body 2 and the rear surface unit 3, are improved due to the signal line 7 and the power source line 8 being wired along the control device 4.

Figure 6:
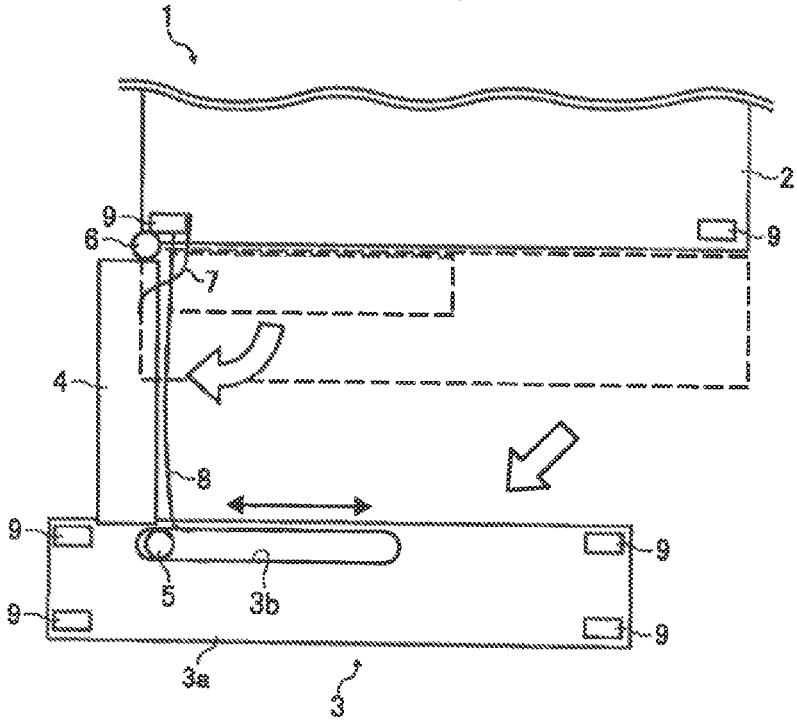
FIG. 6 is a partial outline of a plan view in which the engine main body and the rear surface unit of the image forming apparatus, used in a second embodiment of the present invention, are detached from each other.

FIG. 6 shows a second embodiment of the present invention. When comparing the second embodiment to the above first embodiment, the hinge 5 is fitted into a slot 3*b*, which is formed in, and extends in the width direction there the unit main body 3*a*, and in all other points the structure of two embodiments is identical.

With this structure, when the rear surface unit 3 is detached from the engine main body 2, the unit main body 3*a* can be moved in the width direction of the rear surface unit 3, and the rear surface unit 3 can be prevented from protruding in the width direction thereof.

In each of the above embodiments, an example has been given using a color laser printer as the image forming apparatus 1, however, the image forming apparatus is not limited in this manner, and this invention can be applied to any image forming apparatus in which the rear surface unit is detachable from the engine main body, such as an electrophotographic copying apparatus, a fax machine, or a plotter or any complex mechanism containing the above.

Thus, with the present invention, a working space between the engine main body and the rear surface unit when performing maintenance can be secured without completely disassembling the engine main body and the rear surface unit, thus the efficiency of performing maintenance is improved and the cost is lowered due to the fall preventing member being rendered unnecessary.

Various modifications will become possible for those skilled in the art after receiving the teachings of the present disclosure, without departing from the scope thereof.

What is claimed is:

1. An image forming apparatus comprising:

an engine main body which has image forming means, transfer means, fixing means and transport means, and which performs an image forming operation, a transfer operation and a fixing operation; and a rear surface unit which has housed items such as a power source device, a control device, and an exhaust device, and which is configured to be detachable from the engine main body, wherein the rear surface unit has a unit main body for housing the housed items, the unit main body is detachable from the engine main body, the control device housed in the rear surface unit has a box shape, and one end of the control device is rotatably linked to the engine main body while the other end thereof is rotatably linked to the unit main body.

2. The image forming apparatus according to claim 1, wherein the control device is configured so that maintenance of the inner portion thereof can be performed when the rear surface unit is detached from the engine main body.

3. The image forming apparatus according to claim 1, wherein when the rear surface unit is detached from the engine main body, the rear surface unit and the control device can move relative to each other.

4. The image forming apparatus according to claim 1, further comprising a harness for joining the engine main body and the rear surface unit, and the harness is disposed along the control device.

5. The image forming apparatus according to claim 1, wherein the exhaust device has a duct which is connected to the engine main body.

6. An image forming apparatus comprising:

an image forming engine including an image forming device, a transfer device, a fixer, and a transporter; and a rear unit including a housing which houses a power source device, a control device, and an exhaust device, and which is detachable from the image forming engine, the rear unit being detachable from the image forming engine, the control device having a box shape, and one end of the control device is rotatably linked to the image forming engine while another end of the control device is rotatably linked to the housing.

7. The image forming apparatus according to claim 6, wherein the control device is configured so that maintenance of the inner portion thereof can be performed when the rear unit is detached from the engine.

8. The image forming apparatus according to claim 6, wherein when the rear unit is detached from the engine, the rear unit and the control device are movable relative to each other.

9. The image forming apparatus according to claim 6, further comprising:

a harness, disposed along the control device, for joining the image forming engine and the rear unit.

10. The image forming apparatus according to claim 6, wherein the exhaust device includes a duct which is connected to the engine.

11. The image forming apparatus according to claim 6, wherein:

the image forming engine comprises a main body of the image forming apparatus.

12. The image forming apparatus according to claim 6, wherein:

the rear unit comprises a rear surface unit.

* * * * *